US009717998B2

(12) United States Patent
Cai

(10) Patent No.: US 9,717,998 B2
(45) Date of Patent: Aug. 1, 2017

(54) DOUBLE-SIDED TOY CAR

(71) Applicants: ALPHA GROUP CO., LTD., Shantou (CN); GUANGDONG AULDEY ANIMATION & TOY CO., LTD., Guangzhou (CN); GUANGZHOU ALPHA CULTURE COMMUNICATIONS CO., LTD., Guangzhou (CN)

(72) Inventor: Dongqing Cai, Shantou (CN)

(73) Assignees: ALPHA GROUP CO., LTD., Shantou (CN); GUANGZHOU ALPHA CULTURE COMMUNICATIONS CO., LTD., Guangzhou (CN)

( * ) Notice: Subject to any disclaimer, the term of this patent is extended or adjusted under 35 U.S.C. 154(b) by 0 days.

(21) Appl. No.: 15/314,146

(22) PCT Filed: Jun. 30, 2015

(86) PCT No.: PCT/CN2015/082915
§ 371 (c)(1),
(2) Date: Nov. 28, 2016

(87) PCT Pub. No.: WO2016/050105
PCT Pub. Date: Apr. 7, 2016

(65) Prior Publication Data

US 2017/0189821 A1 Jul. 6, 2017

(30) Foreign Application Priority Data

Sep. 30, 2014 (CN) ..... 2014 1 0517511

(51) Int. Cl.
*A63H 17/00* (2006.01)
*A63H 17/26* (2006.01)
(Continued)

(52) U.S. Cl.
CPC ..... *A63H 17/26* (2013.01); *A63H 17/004* (2013.01); *A63H 17/262* (2013.01);
(Continued)

(58) Field of Classification Search
USPC ..... 446/436, 443, 457, 462, 463, 464, 465
See application file for complete search history.

(56) References Cited

FOREIGN PATENT DOCUMENTS

CN 203264270 U 11/2013
CN 103816665 A 5/2014
(Continued)

OTHER PUBLICATIONS

ISA/CN, International Search Report for PCT/CN2015/082915, Sep. 29, 2015.

*Primary Examiner* — Nini Legesse
(74) *Attorney, Agent, or Firm* — Hodgson Russ LLP

(57) ABSTRACT

A double-sided toy vehicle comprises a vehicle body, a driving mechanism, a transmission mechanism, a driven wheel set, a first driving wheel set and a second driving wheel set, in which the transmission mechanism comprises a reverse gear, a double gear, a transition gear, a first output gear and a second output gear; the reverse gear meshes with a rotating shaft gear of an electrical motor of the driving mechanism, and provided with an axial gear protruding axially and meshing with a first gear of the double gear; the double gear is provided at a position between the first output gear and the second output gear, achieving transmission of power of the electrical motor; the first output gear meshes with a second gear of the double gear through the transition gear, and the second output gear directly meshes with the second gear of the double gear to achieve the transmission.

15 Claims, 4 Drawing Sheets

(51) Int. Cl.

| | |
|---|---|
| ***A63H 29/22*** | (2006.01) |
| ***A63H 18/02*** | (2006.01) |
| ***A63H 18/04*** | (2006.01) |

(52) U.S. Cl.
CPC ..... *A63H 18/028* (2013.01); *A63H 18/04* (2013.01); *A63H 29/22* (2013.01)

(56) References Cited

FOREIGN PATENT DOCUMENTS

| | | | |
|---|---|---|---|
| CN | 104225927 | | 12/2014 |
| CN | 204121750 | U | 1/2015 |
| GB | 2214099 | A | 8/1989 |

DOUBLE-SIDED TOY CAR

CROSS-REFERENCE TO RELATED APPLICATIONS

The present application is a national phase entry under 35 USC §371 of International Application No. PCT/CN2015/082915, filed Jun. 30, 2015, which claims the benefit of and priority to Chinese Patent Application No. 201410517511.0, filed Sep. 30, 2014, the entire disclosures of which are incorporated herein by reference.

FIELD

The present invention relates to a toy vehicle, and more particularly to a double-sided toy vehicle.

BACKGROUND

There are a wide variety of existing toy vehicles, such as a conventional toy vehicle having front wheels and rear wheels provided to a bottom portion of a vehicle body, a toy flip stunt vehicle having auxiliary wheels attached above the vehicle body, and a toy stunt vehicle whose front wheels and rear wheels provided to a bottom portion thereof are designed to have diameters greater than thickness of the vehicle body thereof. These toy vehicles are either configured so that rear wheels are designed as driving wheels, while front wheels are designed as driven wheels, or configured so that front wheels and rear wheels are both designed as driving wheels, i.e. an existing four-wheel drive toy vehicle; the auxiliary wheels of the toy flip stunt vehicle are configured as driven wheels. The conventional toy vehicle cannot run after turning over; the toy flip stunt vehicle can automatically flip back by means of the cooperation of the auxiliary wheels with front wheels/rear wheels after turning over; and although the toy stunt vehicle can continue to run after turning over, the running direction is reversed. None of the toy vehicles can achieve that it will remain stable and continue to run forward after the vehicle body turns over, and similarly, none of the above toy vehicles can run on special track bodies such as a single upper track, or a single side track.

SUMMARY

To solve the above-described problem existing in the related art, the objective of the present invention is to provide a double-sided toy vehicle having a transmission mechanism with a clever design and a compact structure, which can still run after turning over and be used on a special track body.

To attain the above objective, the technical solution adopted by the present invention is that: a double-sided toy vehicle, including a vehicle body, a driving mechanism and a transmission mechanism provided in the vehicle body, a driven wheel set provided to an end of the vehicle body, and a pair of first driving wheels and a pair of second driving wheels provided to the other end of the vehicle body and protruding towards a upper portion and a lower portion of the vehicle body respectively. The double-sided toy vehicle is characterized in that the transmission mechanism includes one reverse gear, at least one double gear, a transition gear, and a first output gear and a second output gear respectively provided on wheel shafts of the two pairs of driving wheels; the reverse gear meshes with a rotating shaft gear of an electrical motor of the driving mechanism, and is provided with an axial gear protruding axially and meshing with a first gear of the double gear; the double gear is provided at a position between the first output gear and the second output gear, and a power transmission from the electrical motor to the first output gear and the second output gear is achieved via the double gear; the first output gear meshes with a second gear of the double gear through the transition gear to achieve the transmission, and the second output gear directly meshes with the second gear of the double gear to achieve the transmission.

In order to achieve that the transmission mechanism is not only applicable to a conventional double-sided toy vehicle, but also applicable to a double-sided toy vehicle with two pairs of driving wheels and capable of automatically performing an elastic adjustment, a rotating shaft is provided in the middle of the double gear, two sides of an interior of the vehicle body are correspondingly provided with shaft holes or slotted holes, and the rotating shaft is mounted in the shaft holes or the slotted holes to realize that the double gear can rotate around the rotating shaft, or rotate around the rotating shaft and move within a range of the slotted holes.

The reverse gear of the present invention may have many different designs as follows: the reverse gear can be designed as a crown gear, the rotating shaft gear is correspondingly designed as a spur gear meshing with crown teeth of the crown gear, and the axial gear is provided on a back surface of the crown gear and is coaxial with the crown gear. The reverse gear can also be designed as a worm, the rotating shaft gear is correspondingly designed as a worm gear meshing with the worm, and the axial gear is provided on an end of the worm and is coaxial with the worm. The reverse gear can still be designed as a first helical gear, the rotating shaft gear is correspondingly designed as a second helical gear meshing with the first helical gear in crossed orientations, and the axial gear is provided on one of surfaces of the first helical gear and is coaxial with the first helical gear.

In order to achieve that the first driving wheel set and the second driving wheel set have the same rotational speed to make the double-sided toy vehicle run on a double-sided track, the transition gear is a gear having the same modulus as the second gear of the double gear.

The transition gear is provided to adjust a distance between the two pairs of driving wheels and the driving mechanism, in which if the distance is great, at least one transition gear can be provided between the first output gear and the second gear of the double gear, and at least one transition gear can be provided between the second output gear and the second gear of the double gear; in order to ensure that the first driving wheels and the second driving wheels rotate in different directions, the difference between the number of the transition gears at the first output gear and that of the transition gears at the second output gear should be an odd number.

An alternative solution is to change a distance between the two pairs of driving wheels by providing a plurality of double gears. For example, two double gears are provided, namely, a first double gear and a second double gear, a first gear of the first double gear and a first gear of the second double gear both mesh with the axial gear, a second gear of the first double gear meshes with the first output gear, a second gear of the second double gear meshes with the transition gear, and the transition gear meshes with the second output gear.

In order to achieve that the double-sided toy vehicle can run on special track bodies, such as a single upper track and a single side track, the first driving wheels are provided to a lower rear portion of the vehicle body and protrude towards the lower portion of the vehicle body, the second driving wheels are provided to an upper rear portion of the vehicle body and protrude towards the upper portion of the vehicle body, and a wheel track of two first driving wheels and a wheel track of two second driving wheels are both same as that of two driven wheels of the driven wheel set. Similarly, the driven wheel set includes a pair of first driven wheels and a pair of second driven wheels, the first driven wheels protrude towards the lower portion of the vehicle body, the second driven wheels protrude towards the upper portion of the vehicle body, and a wheel track of two driven wheels of the first driven wheels is same as that of two driven wheels of the second driven wheels. Of course, the driven wheel set of the present invention may also be configured to include only one pair of driven wheels or more pairs of driven wheels.

The present invention is characterized in that the transmission mechanism includes one reverse gear, at least one double gear, the transition gear, as well as the first output gear and the second output gear respectively provided on wheel shafts of the two pairs of driving wheels; the reverse gear meshes with the rotating shaft gear of the electrical motor of the driving mechanism, and is provided with the axial gear protruding axially and meshing with the first gear of the double gear; the double gear is provided at a position between the first output gear and the second output gear, and a power transmission from the electrical motor to the first output gear and the second output gear is achieved via the double gear; the first output gear meshes with the second gear of the double gear through the transition gear to achieve the transmission, and the second output gear directly meshes with the second gear of the double gear to achieve the transmission.

Since the present invention adopts the transmission mechanism consisting of the reverse gear, the double gear, the transition gear, as well as the first output gear and the second output gear respectively provided on the two pairs of driving wheels, the whole transmission mechanism has a simple and ingenious design, and a compact structure, which greatly saves a space of the vehicle body. The power of the electrical motor is transmitted to the two pairs of driving wheels through the double gear serving as a bridge, which reduces the number of the reverse gears and effectively solves a problem that meshing of a plurality of reverse gears with the rotating shaft gear of the electrical motor tends to cause a rapid loss of energy and service life of the electrical motor. Furthermore, the double gear is provided at a position between the first output gear and the second output gear, which fully utilizes a space in a height direction of the double-sided toy vehicle, and will not increase a width of the vehicle body. Accordingly, the double-sided toy vehicle of the present invention can be designed to be smaller and more beautiful compared with an existing double-sided toy vehicle provided with the plurality of reverse gears. Furthermore, the transmission mechanism is universal for vehicle bodies with different sizes in such a manner that by increasing or decreasing the number of the double gears, a purpose that the distance between the reverse gear and the output gear may be flexibly changed, i.e. the distance between two driving wheels of the double-sided toy vehicle may be adjusted or changed, is achieved, so as to achieve a purpose that the transmission mechanism is applicable to the double-sided toy vehicles with different sizes, which has good applicability. Since the rotating shaft of the double gear may be fixed on the vehicle body, or may flexibly slide on the vehicle body within a certain distance to make the double gear capable of changing its position, the transmission mechanism may be applied to the double-sided toy vehicle having two relatively telescopic driving wheels and adapted to run on rugged roads or specially shaped tracks. Since the wheel track of two driving wheels of the first driving wheels and the wheel track of two driving wheels of the second driving wheels are both same as that of two driven wheels of driven wheel set, contact points between wheels at two sides or upper and lower sides of the double-sided toy vehicle and the track surface can be connected into a rectangle, and further the double-sided toy vehicle may run on a track body only with an upper track surface, or on a track body only with a side track surface, which has special effects, further increases interestingness of the double-sided toy vehicle, and increases freedom and creativity of assembling a toy track body cooperating with the double-sided toy vehicle. The double-sided toy vehicle has a clever design, strong applicability and a high price-performance ratio, such that the performance of the double-sided toy vehicle is effectively improved, and more ways of playing with the toy vehicle and more pleasure are provided.

The present invention will be further described with reference to the following drawings and embodiments.

DETAILED DESCRIPTION

Figure 1:
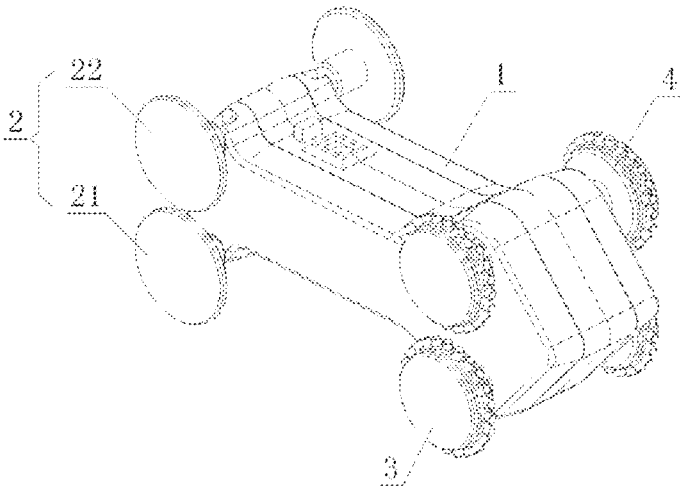
FIG. 1 is a perspective view of a structure of the present invention.
Figure 2:
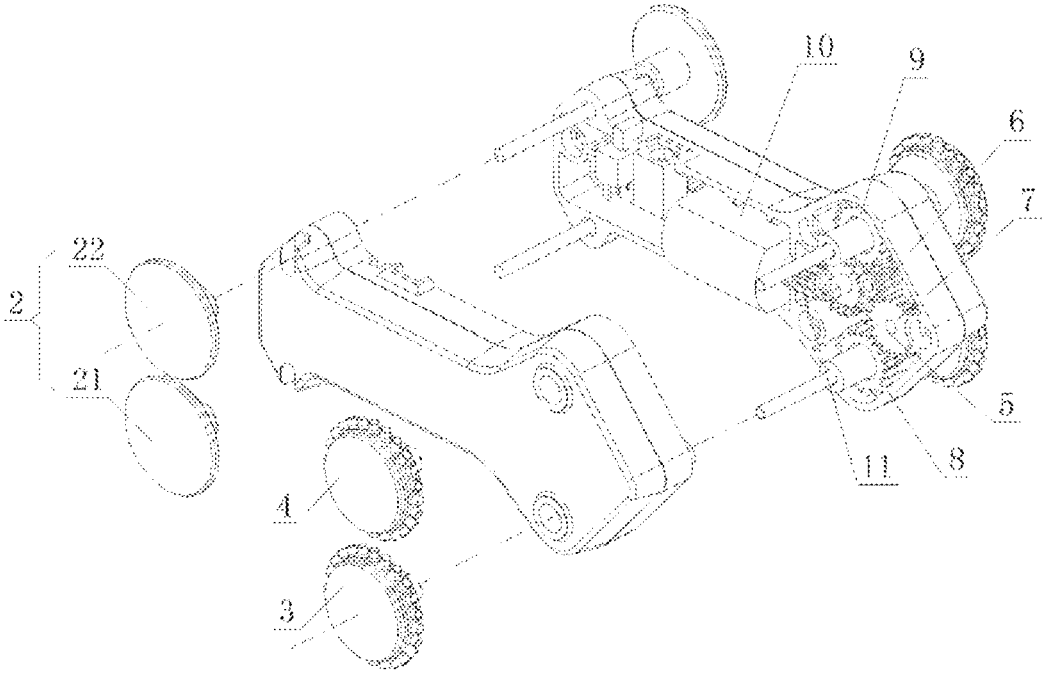
FIG. 2 is an exploded view of a structure of the present invention.
Figure 3:
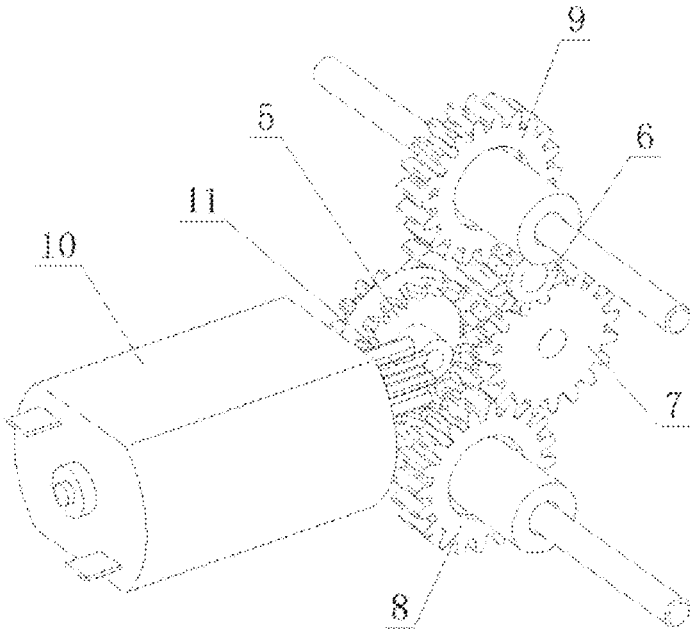
FIG. 3 is a perspective view of a structure of a first transmission mechanism of the present invention.
Figure 4:
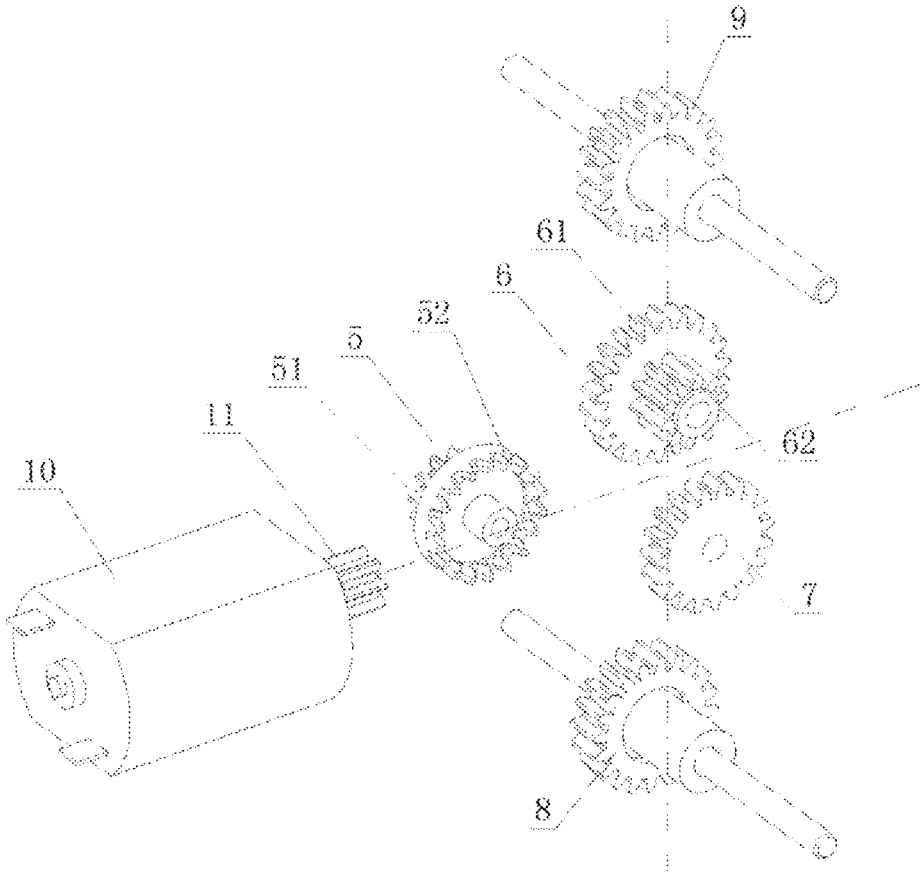
FIG. 4 is an exploded view of a structure of a first transmission mechanism of the present invention.

As shown in FIGS. 1 and 4, a double-sided toy vehicle of the present invention includes a vehicle body 1, a driving mechanism and a transmission mechanism provided in the vehicle body 1, a driven wheel set 2 provided to an end of the vehicle body 1, and a pair of first driving wheels 3 and a pair of second driving wheels 4 provided to the other end of the vehicle body 1 and protruding towards a upper portion and a lower portion of the vehicle body 1 respectively, in which the transmission mechanism includes a reverse gear 5, a double gear 6, a transition gear 7, and a first output gear 8 and a second output gear 9 provided on wheel shafts of the two pairs of driving wheels. The reverse gear 5 meshes with a rotating shaft gear 11 of an electrical motor 10 in the driving mechanism, and is provided with an axial gear 51 protruding axially and meshing with a first gear 61 of the double gear 6. The double gear 6 is provided at a position between the first output gear 8 and the second output gear 9, and a power transmission from the electrical motor 10 to the first output gear 8 and the second output gear 9 is achieved through the double gear 6, the first output gear 8 meshes with a second gear 62 of the double gear 6 through the transition gear 7 to achieve the transmission, and the second output gear 9 directly meshes with the second gear 62 of the double gear 6 to achieve the transmission. The whole transmission mechanism has a simple and ingenious design, and a compact structure, which greatly saves a space of the vehicle body, so the vehicle body 1 of the toy vehicle can be designed to be smaller. The power of the electrical motor 10 is transmitted to the two pairs of driving wheels through the double gear 6 serving as a bridge, which reduces the number of the reverse gear 5, and effectively solves a problem that meshing of a plurality of reverse gears 5 with the rotating shaft gear 11 of the electrical motor 10 tends to cause a rapid loss of energy and service life of the electrical motor 10. Furthermore, a space in a height direction of the double-sided toy vehicle is fully utilized, which may not increase a width of the vehicle body. Accordingly, the double-sided toy vehicle of the present invention can be designed to be smaller and more beautiful compared with an existing double-sided toy vehicle provided with the plurality of reverse gears.

Embodiment 1

Figure 7:
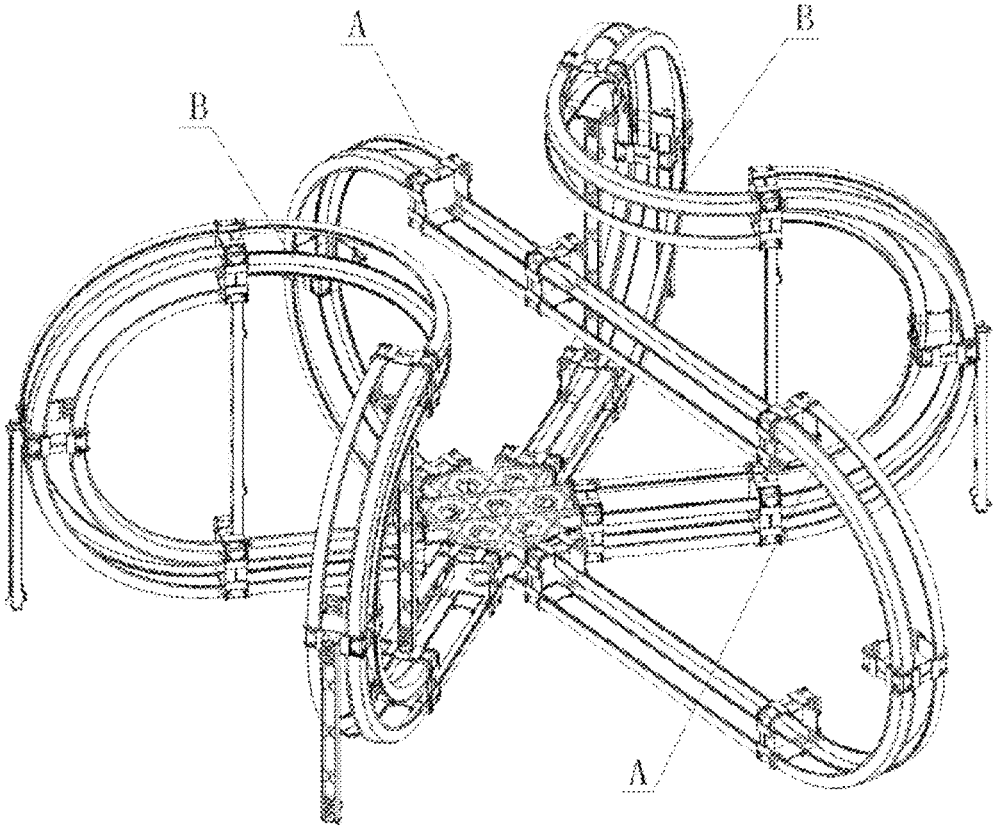
FIG. 7 is a special track body applied by the present invention.

As shown in FIGS. 1 to 4, the transmission mechanism of this embodiment includes one reverse gear 5, one double gear 6, one transition gear 7, the first output gear 8 and the second output gear 9. The reverse gear 5 is a crown gear, the rotating shaft gear 11 is correspondingly designed as a spur gear meshing with crown teeth 52 of the crown gear, and the axial gear 51 is provided on a back surface of the crown gear and coaxial with the crown gear. A big gear (i.e. the first gear 61) of the double gear 6 meshes with the axial gear 51, and an upper portion of a pinion gear (i.e. the second gear 62) of the double gear 6 meshes with the second output gear 9. The second output gear 9 is provided on a wheel shaft of the second driving wheels 4, and the second driving wheels 4 are two driving wheels provided to an upper rear portion of the vehicle body 1 and protruding towards the upper portion of the vehicle body 1. A lower portion of the pinion gear (i.e. the second gear 62) of the double gear 6 meshes with the transition gear 7, and the transition gear 7 also meshes with the first output gear 8. The first output gear 8 is provided on a wheel shaft of the first driving wheels 3, and the first driving wheels 3 are two driving wheels provided to a lower rear portion of the vehicle body 1 and protruding towards the lower portion of the vehicle body 1. A wheel track of the two first driving wheels 3 of the vehicle body 1 is same as that of the two second driving wheels 4. The driven wheel set 2 of the vehicle body 1 includes a pair of first driven wheels 21 and a pair of second driven wheels 22, in which the first driven wheels 21 protrude towards the lower portion of the vehicle body 1, and the second driven wheels 22 protrude towards the upper portion of the vehicle body 1. Similarly, a wheel track of the two first driven wheels 21 is same as that of the two second driven wheels 22, and the wheel track of the driven wheels is also same as that of the driving wheels, so the double-sided toy vehicle may run on a track body only with an upper track surface, as shown by mark A in FIG. 7, and may also run on a track body only with a side track surface, as shown by mark B in FIG. 7, which has special effects and lots of interestingness.

Embodiment 2

Figure 5:
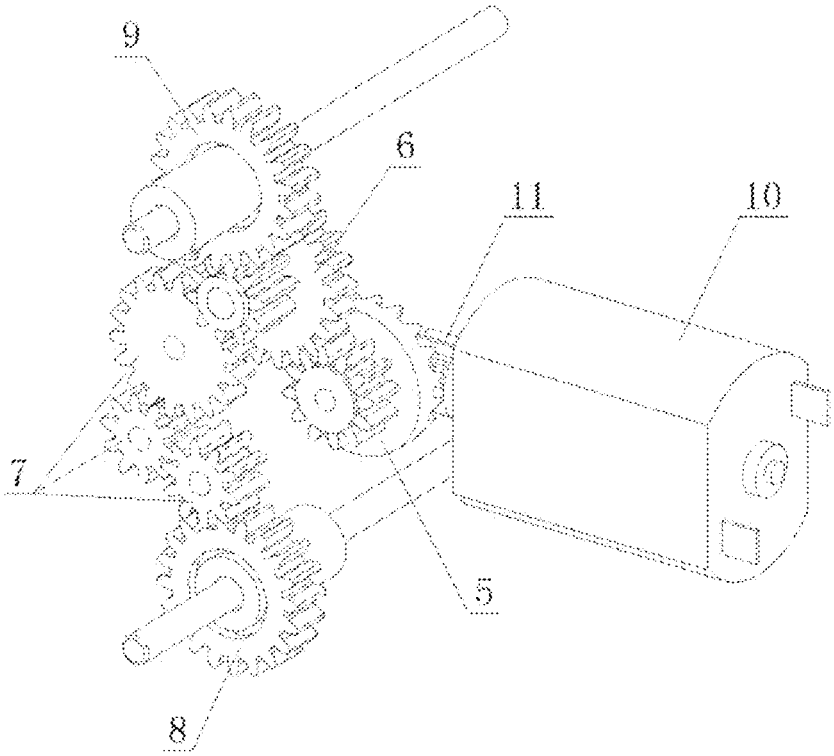
FIG. 5 is a perspective view of a structure of a second transmission mechanism of the present invention.

As shown in FIG. 5, the transmission mechanism of this embodiment includes one reverse gear 5, one double gear 6, three transition gears 7, the first output gear 8 and the second output gear 9. The reverse gear 5 is the crown gear, the rotating shaft gear 11 is correspondingly designed as the spur gear meshing with crown teeth 52 of the crown gear, and the axial gear 51 is provided on the back surface of the crown gear and coaxial with the crown gear. The big gear (i.e. the first gear 61) of the double gear 6 meshes with the axial gear 51, and the upper portion of the pinion gear (i.e. the second gear 62) of the double gear 6 meshes with the second output gear 9. The second output gear 9 is provided on the wheel shaft of the second driving wheels 4, and the second driving wheels 4 are two driving wheels provided to the upper rear portion of the vehicle body 1 and protruding towards the upper portion of the vehicle body 1. The lower portion of the pinion gear (i.e. the second gear 62) of the double gear 6 meshes with a first transition gear 7, the first transition gear 7 further meshes with a second transition gear 7, the second transition gear 7 further meshes with a third transition gear 7, and finally the third transition gear 7 meshes with the first output gear 8. The first output gear 8 is provided on the wheel shaft of the first driving wheels 3, and the first driving wheels 3 are two driving wheels provided to the lower rear portion of the vehicle body 1 and protruding towards the lower portion of the vehicle body 1. Only when the number of the transition gears 7 is an odd number, it can be ensured that the pair of first driving wheels 3 and the pair of second driving wheels 4 rotate in different directions.

Embodiment 3

Figure 6:
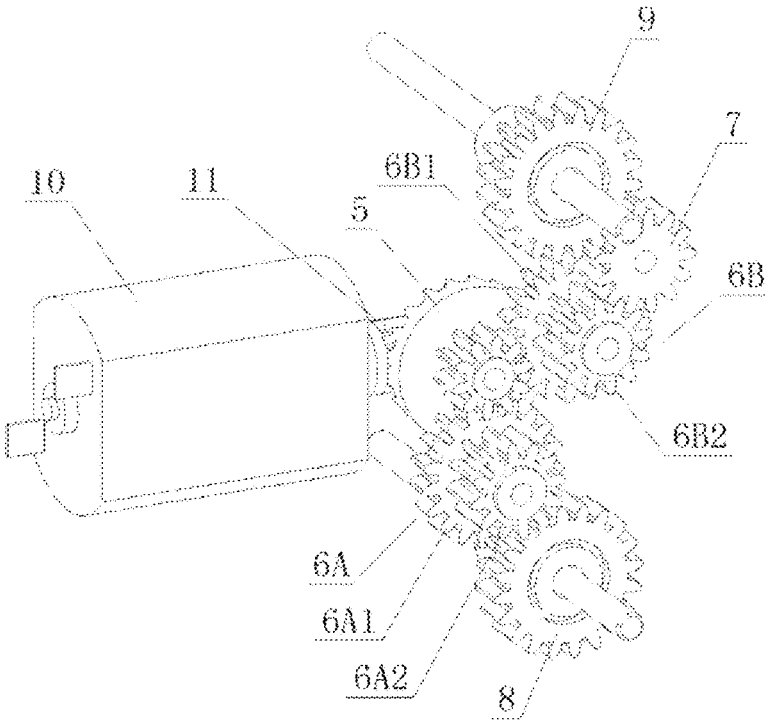
FIG. 6 is a perspective view of a structure of a third transmission mechanism of the present invention.

As shown in FIG. 6, the transmission mechanism of this embodiment includes one reverse gear 5, a first double gear 6A, a second double gear 6B, one transition gear 7, the first output gear 8 and the second output gear 9. The reverse gear 5 is the crown gear, the rotating shaft gear 11 is correspondingly designed as the spur gear meshing with crown teeth 52 of the crown gear, and the axial gear 51 is provided on the back surface of the crown gear and coaxial with the crown gear. A big gear (i.e. the first gear 6A1) of the first double gear 6A meshes with a lower end of the axial gear 51, a pinion gear (i.e. the second gear 6A2) of the first double gear 6A meshes with the first output gear 8, the first output gear 8 is provided on the wheel shaft of the first driving wheels 3, and the first driving wheels 3 are two driving wheels provided to the lower rear portion of the vehicle body 1 and protruding towards the lower portion of the vehicle body 1; a big gear (i.e. the first gear 6B1) of the second double gear 6B meshes with an upper end of the axial gear 51, a pinion gear (i.e. the second gear 6B2) of the second double gear 6B meshes with the transition gear 7, the transition gear 7 further meshes with the second output gear 9, the second output gear 9 is provided on the wheel shaft of the second driving wheels 4, and the second driving wheels 4 are two driving wheels provided to the upper rear portion of the vehicle body 1 and protruding towards the upper portion of the vehicle body 1.

Although the present invention is described according to specific embodiments, but it cannot construed to limit the present invention. Other changes of the disclosed embodiments can be expected by those skilled in the art with reference to the description, and these changes are within the scope of the appended claims.

What is claimed is:

1. A double-sided toy vehicle, comprising:

a vehicle body (1);

a driving mechanism and a transmission mechanism provided in the vehicle body (1);

a driven wheel set (2) provided to an end of the vehicle body (1); and a pair of first driving wheels (3) and a pair of second driving wheels (4) provided to the other end of the vehicle body (1) and protruding towards an upper portion and a lower portion of the vehicle body (1) respectively;

wherein the transmission mechanism comprises one reverse gear (5), at least one double gear (6), a transition gear (7), and a first output gear (8) and a second output gear (9) respectively provided on wheel shafts of the two pairs of driving wheels; the reverse gear (5) meshes with a rotating shaft gear (11) of an electrical motor (10) of the driving mechanism, and is provided with an axial gear (51) protruding axially and meshing with a first gear of the double gear; the double gear is provided at a position between the first output gear and the second output gear, and a power transmission from the electrical motor to the first output gear and the second output gear is achieved via the double gear; the first output gear meshes with a second gear of the double gear through the transition gear to achieve the transmission, and the second output gear directly meshes with the second gear of the double gear to achieve the transmission.

2. The double-sided toy vehicle according to claim 1, wherein a rotating shaft is provided in the middle of the double gear, two sides of an interior of the vehicle body are correspondingly provided with shaft holes or slotted holes, and the rotating shaft is mounted in the shaft holes or the shaft holes to achieve that the double gear can rotate around the rotating shaft, or rotate around the rotating shaft and move within a range of the slotted holes.

3. The double-sided toy vehicle according to claim 2, wherein the reverse gear (5) is a crown gear, the rotating shaft gear (11) is correspondingly designed as a spur gear meshing with crown teeth (52) of the crown gear, and the axial gear (51) is provided on a back surface of the crown gear and is coaxial with the crown gear.

4. The double-sided toy vehicle according to claim 2, wherein the reverse gear (5) is a worm, the rotating shaft gear (11) is correspondingly designed as a worm gear meshing with the worm, and the axial gear (51) is provided on an end of the worm and is coaxial with the worm.

5. The double-sided toy vehicle according to claim 2, wherein the reverse gear (5) is a first helical gear, the rotating shaft gear (11) is correspondingly designed as a second helical gear meshing with the first helical gear in crossed orientations, and the axial gear (51) is provided on one of surfaces of the first helical gear and is coaxial with the first helical gear.

6. The double-sided toy vehicle according to claim 2, wherein the transition gear (7) is a gear having the same modulus as the second gear (62) of the double gear (6) to achieve that the first output gear and the second output gear have the same rotational speed.

7. The double-sided toy vehicle according to claim 2, wherein at least one transition gear is provided between the first output gear (8) and the second gear (62) of the double gear (6), meanwhile at least one transition gear is provided between the second output gear (9) and the second gear (62) of the double gear (6), and the difference between the number of the transition gears at the first output gear and that of the transition gears at the second output gear is an odd number.

8. The double-sided toy vehicle according to claim 1, wherein the reverse gear (5) is a crown gear, the rotating shaft gear (11) is correspondingly designed as a spur gear meshing with crown teeth (52) of the crown gear, and the axial gear (51) is provided on a back surface of the crown gear and is coaxial with the crown gear.

9. The double-sided toy vehicle according to claim 1, wherein the reverse gear (5) is a worm, the rotating shaft gear (11) is correspondingly designed as a worm gear meshing with the worm, and the axial gear (51) is provided on an end of the worm and is coaxial with the worm.

10. The double-sided toy vehicle according to claim 1, wherein the reverse gear (5) is a first helical gear, the rotating shaft gear (11) is correspondingly designed as a second helical gear meshing with the first helical gear in crossed orientations, and the axial gear (51) is provided on one of surfaces of the first helical gear and is coaxial with the first helical gear.

11. The double-sided toy vehicle according to claim 1, wherein the transition gear (7) is a gear having the same modulus as the second gear (62) of the double gear (6) to achieve that the first output gear and the second output gear have the same rotational speed.

12. The double-sided toy vehicle according to claim 1, wherein at least one transition gear is provided between the first output gear (9) and the second gear (62) of the double gear (6), meanwhile at least one transition gear is provided between the second output gear (9) and the second gear (62) of the double gear (6), and the difference between the number of the transition gears at the first output gear and that of the transition gears at the second output gear is an odd number.

13. The double-sided toy vehicle according to claim 1, wherein two double gears are provided, namely a first double gear (6A) and a second double gear (6B), a first gear (6A1) of the first double gear (6A) and a first gear (6B1) of the second double gear (6B) both mesh with the axial gear (51), a second gear (6A2) of the first double gear (6A) meshes with the first output gear (8), a second gear (6B2) of the second double gear (6B) meshes with the transition gear (7), and the transition gear (7) meshes with the second output gear (9).

14. The double-sided toy vehicle according to claim 1, wherein the first driving wheels (3) are provided to a lower rear portion of the vehicle body (1) and protrude towards the lower portion of the vehicle body (1), the second driving wheels (4) are provided to an upper rear portion of the vehicle body (1) and protrude towards the upper portion of the vehicle body (1), and a wheel track of two first driving wheels (3) and a wheel track of two second driving wheels (4) are both same as that of two driven wheels of the driven wheel set (2).

15. The double-sided toy vehicle according to claim 1, wherein the driven wheel set (2) comprises a pair of first driven wheels (21) and a pair of second driven wheels (22), the first driven wheels (21) protrude towards the lower portion of the vehicle body (1), the second driven wheels (22) protrude towards the upper portion of the vehicle body (1), and a wheel track of two driven wheels of the first driven wheels (21) are same as that of two driven wheels of the second driven wheels (22).

* * * * *